US012037562B2

(12) United States Patent
Junuzovic et al.

(10) Patent No.: US 12,037,562 B2
(45) Date of Patent: Jul. 16, 2024

(54) NON-NEWTONIAN ENGINE OIL LUBRICANT COMPOSITIONS FOR SUPERIOR FUEL ECONOMY

(71) Applicant: EXXONMOBIL TECHNOLOGY AND ENGINEERING COMPANY, Annandale, NJ (US)

(72) Inventors: Haris Junuzovic, Hamburg (DE); Douglas E. Deckman, Easton, PA (US); Benjamin D. Eirich, Frenchtown, NJ (US)

(73) Assignee: EXXONMOBIL TECHNOLOGY AND ENGINEERING COMPANY, Annandale, NJ (US)

( * ) Notice: Subject to any disclaimer, the term of this patent is extended or adjusted under 35 U.S.C. 154(b) by 0 days.

(21) Appl. No.: 17/904,254

(22) PCT Filed: Jan. 14, 2021

(86) PCT No.: PCT/US2021/013341
§ 371 (c)(1),
(2) Date: Aug. 15, 2022

(87) PCT Pub. No.: WO2021/178047
PCT Pub. Date: Sep. 10, 2021

(65) Prior Publication Data

US 2023/0105922 A1 Apr. 6, 2023

Related U.S. Application Data

(60) Provisional application No. 62/984,434, filed on Mar. 3, 2020.

(51) Int. Cl.

| | |
|---|---|
| ***C10M 169/04*** | (2006.01) |
| ***C10M 101/00*** | (2006.01) |
| ***C10M 107/02*** | (2006.01) |
| ***C10M 111/04*** | (2006.01) |
| ***C10M 129/74*** | (2006.01) |
| ***C10M 133/44*** | (2006.01) |
| ***C10M 139/00*** | (2006.01) |
| ***C10M 141/12*** | (2006.01) |
| ***C10M 145/28*** | (2006.01) |
| ***C10M 161/00*** | (2006.01) |
| *C10N 20/02* | (2006.01) |
| *C10N 30/00* | (2006.01) |
| *C10N 30/02* | (2006.01) |
| *C10N 30/04* | (2006.01) |
| *C10N 40/25* | (2006.01) |

(52) U.S. Cl.
CPC ..... *C10M 169/044* (2013.01); *C10M 101/00* (2013.01); *C10M 107/02* (2013.01); *C10M 111/04* (2013.01); *C10M 129/74* (2013.01); *C10M 133/44* (2013.01); *C10M 139/00* (2013.01); *C10M 141/12* (2013.01); *C10M 145/28* (2013.01); *C10M 161/00* (2013.01); *C10M 2203/003* (2013.01); *C10M 2205/0206* (2013.01); *C10M 2207/283* (2013.01); *C10M 2209/104* (2013.01); *C10M 2215/30* (2013.01); *C10M 2227/061* (2013.01); *C10N 2020/02* (2013.01); *C10N 2030/02* (2013.01); *C10N 2030/04* (2013.01); *C10N 2030/54* (2020.05); *C10N 2030/74* (2020.05); *C10N 2040/25* (2013.01)

(58) Field of Classification Search
None
See application file for complete search history.

(56) References Cited

U.S. PATENT DOCUMENTS

| | | | | |
|---|---|---|---|---|
| 2003/0088133 | A1* | 5/2003 | O'Rear | C10M 105/04 585/323 |
| 2013/0012421 | A1* | 1/2013 | Smith | C10M 171/02 508/578 |
| 2013/0090273 | A1 | 4/2013 | Martin et al. | |
| 2016/0264907 | A1* | 9/2016 | Chen | C10M 145/38 |
| 2018/0273870 | A1 | 9/2018 | Burns, III et al. | |

OTHER PUBLICATIONS

Written and International Search Report of corresponding PCT application No. PCT/US2021/013341 mailed May 12, 2021.
Publication of Parent PCT application No. PCT/US2021/013341 filed Jan. 14, 2021.

* cited by examiner

*Primary Examiner* — Vishal V Vasisth
(74) *Attorney, Agent, or Firm* — Vorys, Sater, Seymour and Pease, LLP

(57) ABSTRACT

Provided is an engine oil lubricant composition with improved fuel efficiency. The engine oil lubricant composition may include: a polyalpha olefin base oil component an amount of about 50 wt % to about 90 wt % based on a total weight of the engine oil lubricant composition, wherein the polyalpha olefin base oil component is a Group IV base oil and has a Noack volatility of about 12.5% to about 15%; a Group II base oil component in an amount of about 0.1 wt % to about 50 wt % based on the total weight of the engine oil lubricant composition. The engine oil lubricant composition may have (i) a kinematic viscosity at 100° C. of about 10 cSt or less, (ii) a high temperature high shear viscosity at 150° C. of about 2.2 cP or less, and (iii) a Noack volatility of about 20% or less.

17 Claims, No Drawings

NON-NEWTONIAN ENGINE OIL LUBRICANT COMPOSITIONS FOR SUPERIOR FUEL ECONOMY

This application is a 371 of PCT/US2021/013341, filed Jan. 14, 2021 wherein PCT/US2021/013341 is a PRO of 62/984,434, filed Mar. 3, 2020.

FIELD

This application relates to engine oil lubricants compositions and methods for making same. Such compositions are useful for gasoline and diesel engines and provide excellent fuel efficiency.

BACKGROUND OF THE INVENTION

There is currently a trend toward maximizing the fuel economy benefits provided by passenger car engine oil lubricant compositions. Fuel efficiency requirements for passenger vehicles are becoming increasingly more stringent. New legislation in the United States and European Union within the past few years has set fuel economy and carbon emissions targets not readily achievable with today's vehicle and lubricant technology. Due to these more stringent governmental regulations for vehicle fuel consumption and carbon emissions, use of low viscosity engine oil lubricant compositions to meet these regulatory standards is becoming more prevalent.

A major challenge in use of low viscosity engine oil lubricant composition is simultaneously increasing fuel efficiency while also maintaining engine wear protection and low oil consumption. The use of low viscosity base oils provides a fuel efficiency benefit, but can result in increased volatility and oil consumption.

There remains a need for an engine oil lubricant that effectively improves fuel economy while also providing desirable levels for Noack volatility.

SUMMARY OF THE INVENTION

Disclosed herein is an example engine oil lubricant composition. The engine oil lubricant composition may include a polyalpha olefin base oil component an amount of about 50 wt % to about 90 wt % based on a total weight of the engine oil lubricant composition. The polyalpha olefin base oil component may be a Group IV base oil and have a Noack volatility of about 12.5% to about 15%. The engine oil lubricant composition may further include a Group II base oil component in an amount of about 0.1 wt % to about 50 wt % based on the total weight of the engine oil lubricant composition. The engine oil lubricant composition may have a kinematic viscosity at 100° C. of about 10 cSt or less. The engine oil lubricant composition further has a high temperature high shear viscosity at 150° C. of about 2.2 cP or less. The engine oil lubricant composition may have a Noack volatility of about 20% or less.

Further disclosed herein is another example engine oil lubricant composition. The engine oil lubricant composition may include a polyalpha olefin base oil component in an amount of about 52 wt % to about 70 wt % based on a total weight of the engine oil lubricant composition. The polyalpha olefin base oil component may be a Group IV base oil and have a Noack volatility of about 12.5% to about 15%. The engine oil lubricant composition may further include a gas to liquids base oil component in an amount of about 8 wt % to about 29 wt % based on the total weight of the engine oil lubricant composition. The engine oil lubricant composition may further include a first succinimide dispersant that is non-borated and present in an amount of about 0.1 wt % to about 8 wt % based on the total weight of the engine oil lubricant composition. The engine oil lubricant composition may further include a second succinimide dispersant in an amount of about 0.1 wt % to about 8 wt %, based on the total weight of the engine oil lubricant composition, wherein the second succinimide dispersant has a peak molecular weight of about 4000 to about 6000, as determined using gel permeation chromatography with polystyrene calibration standards. The engine oil lubricant composition may further include polymeric ethylene oxide friction modifier in an amount of about 0.1 wt % to about 5.0 wt % based on the total weight of the engine oil lubricant composition. The engine oil lubricant composition may have a kinematic viscosity at 100° C. of about 6 cSt or less. The engine oil lubricant composition may have a high temperature high shear viscosity at 150° C. of about 2.2 cP or less. The engine oil lubricant composition may have a Noack volatility of about 10% to about 18%.

DETAILED DESCRIPTION

The following is a detailed description of the disclosure provided to aid those skilled in the art in practicing the present disclosure. Those of ordinary skill in the art may make modifications and variations in the embodiments described herein without departing from the spirit or scope of the present disclosure. Unless otherwise defined, all technical and scientific terms used herein have the same meaning as commonly understood by one of ordinary skill in the art to which this disclosure belongs. The terminology used in the description of the disclosure herein is for describing particular embodiments only and is not intended to be limiting of the disclosure. All publications, patent applications, patents, figures and other references mentioned herein are expressly incorporated by reference in their entirety.

The present disclosure relates to engine oil lubricant compositions. In accordance with present embodiments, the engine oil lubricant compositions may comprise a polyalpha olefin ("PAO") base oil component having a Noack volatility of about 12% to about 15% and a Group II base oil component. Example embodiments of the engine oil lubricant compositions may also include additional additives, such as dispersants and frictions reducers.

It has now been found that particular embodiments of the engine oil lubricant compositions may provide improved fuel efficiency and desirable levels of Noack volatility. By way of example, inclusion of a polymeric ethylene oxide friction modifier can provide improved fuel efficiency with desirable levels of Noack volatility. In addition, use of certain dispersants can also improve fuel efficiency with desirable levels of Noack volatility. For example, non-borated succinimide dispersants can improve fuel efficiency with desirable levels of Noack volatility as compared to borated dispersants. By way of further example, low molecular weight succinimide dispersants can also improve fuel efficiency with desirable levels of Noack volatility.

In some embodiments, the engine oil lubricant compositions may be non-Newtonian in terms of viscometric properties. A non-Newtonian fluid is a fluid in which the viscous stresses arising from its flow, at every point, are not linearly proportional to the local strain rate. For a non-Newtonian fluid, the viscosity (the measure of a fluid's ability to resist gradual deformation by shear or tensile stresses) is dependent on shear rate or shear rate history. By contrast, a Newtonian fluid is a fluid that in which the viscous stresses arising from its flow, at every point, are linearly proportional to the local strain rate, that is the rate of change of its deformation over time.

In some embodiments, the engine oil lubricant compositions may have a relatively low kinematic viscosity at 100° C. ("KV100"). As used herein, the terms "kinematic viscosity at 100° C." or "KV100" of an engine oil lubricant compositions or base oil component thereof refers to the kinematic viscosity at 100° C. as measured in accordance with ASTM D445. In some embodiments, the engine oil lubricant compositions may have a KV100 of about 10 centistokes (cSt) or less, or about 8 cSt or less, or about 6 cSt, or about 4 cSt or less, or about 2 cSt or less.

In some embodiments, the engine oil lubricant compositions may have a relatively low HTHS viscosity at 150° C. As used herein, the term "HTHS viscosity" of an engine oil lubricant compositions or base oil component thereof refers to high temperature high shear ("HTHS") viscosity as measured in accordance with ASTM D4683. In some embodiments, the engine oil lubricant compositions may have a HTHS viscosity at 150° C. of about 2.2 centipoise ("cP") or less, or about 2.0 cP or less, or about at 1.0 cP or less, or about 1.8 cP or less, or about 1.7 cP or less. In some embodiments, the engine oil lubricant compositions have an HTHS viscosity of about 1.5 cP to about 2.2 cP, or about 1.8 cP to about 2.2 cP, or about 1.9 cP to about 2.1 cP. The HTHS viscosity at 150° C. is a measure of fuel efficiency with lower HTHS values yielding improved fuel economy in direct injection engines, gasoline engines, and diesel engines.

In some embodiments, the engine oil lubricant compositions may have a Noack volatility that is desirable for particular applications. As used herein, the term "Noack volatility" refers to the weight loss of the tested component as determined in accordance with ASTM D5800. In some embodiments, the engine oil lubricant compositions may have a Noack volatility of about 20 wt % or less, or about 18 wt % or less, or about 16 wt % or less, or about 15 wt % or less. In some embodiments, the engine oil lubricant compositions may have a Noack volatility of about 10 wt % to about 18 wt %, or about 12 wt % to about 16 wt %, or about 14 wt % to about 16 wt %.

Also provided herein is a method for improving fuel efficiency and Noack volatility in an engine lubricated with a lubricating oil by using an engine oil lubricant composition described herein as the lubricating oil. In some embodiment, the engine oil lubricant composition includes a PAO base oil component in an amount of about 50 wt % to about 90 wt % based on a total weight of the engine oil lubricant composition and a Group II base oil component in an amount of about 0.1 wt % to about 50 wt % based on the total weight of the engine oil lubricant composition. In some embodiments, the engine oil composition may further comprise one or more of the following additives: (i) a non-borated succinimide dispersant in an amount of about 0.1 wt % to about 8 wt % based on the total weight of the engine oil lubricant composition; (ii) a dispersant in an amount of about 0.1 wt % to about 8 wt %, based on the total weight of the engine oil lubricant composition, wherein the dispersant has a peak molecular weight of about 6000 or less; and (iii) a polymeric ethylene oxide friction modifier in an amount of about 0.1 wt % to about 5.0 wt % based on the total weight of the engine oil lubricant composition. The engine oil lubricant composition may be used to lubricate internal combustion engines, including, but not limited to, direct injection engines, gasoline engines, and diesel engines.

Also provided herein is a method of making an engine oil lubricant composition. The engine oil lubricant composition may be made by providing a PAO base oil component, a Group II base oil component, an optional non-borated succinimide dispersant having a peak molecular weight of about 6000 or less, and an optional polymeric ethylene oxide friction modifier. The method for making the engine oil composition may further include blending from 50 wt % to 90 wt % of the PAO base stock with from 0.1 wt % to 50 wt % the Group II base stock, from 0.1 wt % to about 8 wt % of the optional non-borated succinimide dispersant, from about 0.1 wt % to about 8 wt % of the optional succinimide dispersant having a peak molecular weight of about 6000 or less, and from 0.1 wt % to about 5.0 wt % of the optional polymeric ethylene oxide friction modifier, based on the total weight of the lubricant composition.

The engine oil lubricant compositions, methods of using the lubricant compositions and methods of making the lubricant composition yield an engine oil having a kinematic viscosity at 100° C. of about 10 cSt or less, an HTHS viscosity at 150° C. of about 2.2 cP or less, and a Noack volatility of about 20 wt % of less. The engine oil lubricant compositions are particularly suitable as 0W-4, 0W-8, 0W-12 and 0W-16 viscosity grade engine oils.

Base Oils

Examples embodiments of the engine oil lubricant compositions may include one or more base oils. In some embodiments, the engine oil lubricant compositions may include a PAO base oil component and a Group II base oil component. Optionally, the engine oil lubricant compositions may further include a Group V base oil component.

Lubricating base oils that are useful in the present disclosure are both natural oils, and synthetic oils, and unconventional oils (or mixtures thereof) can be used unrefined, refined, or rerefined (the latter is also known as reclaimed or reprocessed oil). Unrefined oils are those obtained directly from a natural or synthetic source and used without added purification. These include shale oil obtained directly from retorting operations, petroleum oil obtained directly from primary distillation, and ester oil obtained directly from an esterification process. Refined oils are similar to the oils discussed for unrefined oils except refined oils are subjected to one or more purification steps to improve at least one lubricating oil property. One skilled in the art is familiar with many purification processes. These processes include solvent extraction, secondary distillation, acid extraction, base extraction, filtration, and percolation. Rerefined oils are obtained by processes analogous to refined oils but using an oil that has been previously used.

Groups I, II, III, IV and V are broad categories of base oil stocks developed and defined by the American Petroleum Institute (API Publication 1509; www.API.org) to create guidelines for lubricant base oils. Group I base stocks generally have a viscosity index of between about 80 to 120 and contain greater than about 0.03% sulfur and/or less than about 90% saturates. As used herein, viscosity index (VI) is determined by ASTM D2270. Group II base stocks generally have a viscosity index of between about 80 to 120, and contain less than or equal to about 0.03% sulfur and greater than or equal to about 90% saturates. Group III stocks generally have a viscosity index greater than about 120 and contain less than or equal to about 0.03% sulfur and greater than about 90% saturates. Group IV includes polyalphaolefins (PAO). Group V base stock includes base stocks not included in Groups I-IV.

Non-limiting exemplary Group V base stocks include alkylated naphthalene base stock, ester base stock, aliphatic ether base stock, aryl ether base stock, ionic liquid base stock, and combinations thereof.

The table below summarizes properties of each of these five groups.

TABLE 1

| Base Oil Properties | | | |
|---|---|---|---|
| | Saturates | Sulfur | Viscosity Index |
| Group I | <90 &/or | >0.03% & | ≥80 & <120 |
| Group II | ≥90 & | ≤0.03% & | ≥80 & <120 |
| Group III | ≥90 & | ≤0.03% & | ≥120 |
| Group IV | Includes polyalphaolefins (PAO) | | |
| Group V | All other base oil stocks not included in Groups I, II, III, or IV | | |

Natural oils include animal oils, vegetable oils (castor oil and lard oil, for example), and mineral oils. Animal and vegetable oils possessing favorable thermal oxidative stability can be used. Mineral oils vary widely as to their crude source, for example, as to whether they are paraffinic, naphthenic, or mixed paraffinic-naphthenic. Oils derived from coal or shale are also useful. Natural oils vary also as to the method used for their production and purification, for example, their distillation range and whether they are straight run or cracked, hydrorefined, or solvent extracted.

Group II and/or Group III hydroprocessed or hydrocracked basestocks, including synthetic oils such as polyalphaolefins, alkyl aromatics and synthetic esters are also well known base stock oils.

Synthetic oils include hydrocarbon oil. Hydrocarbon oils include oils such as polymerized and interpolymerized olefins (polybutylenes, polypropylenes, propylene isobutylene copolymers, ethylene-olefin copolymers, and ethylene-alphaolefin copolymers, for example). Polyalphaolefin (PAO) oil base stocks are commonly used synthetic hydrocarbon oil. By way of example, PAOs derived from $C_8$, $C_{10}$, $C_{12}$, $C_{14}$ olefins or mixtures thereof may be utilized.

The number average molecular weights of the PAOs, which are known materials and generally available on a major commercial scale from suppliers such as ExxonMobil Chemical Company, Chevron Phillips Chemical Company, BP, and others, typically vary from about 250 to about 3,000, although PAO's may be made in viscosities up to about 100 cSt (100° C.). The PAOs are typically comprised of relatively low molecular weight hydrogenated polymers or oligomers of alphaolefins which include, but are not limited to, $C_2$ to about $C_{32}$ alphaolefins with the $C_8$ to about $C_{16}$ alphaolefins, such as 1-octene, 1-decene, 1-dodecene and the like. Specific examples of suitable polyalphaolefins are poly-1-octene, poly-1-decene and poly-1-dodecene and mixtures thereof and mixed olefin-derived polyolefins. However, the dimers of higher olefins in the range of $C_{14}$ to $C_{18}$ may be used to provide low viscosity basestocks of acceptably low volatility. Depending on the viscosity grade and the starting oligomer, the PAOs may be predominantly trimers and tetramers of the starting olefins, with minor amounts of the higher oligomers, having a viscosity range of 1.5 to 12 cSt.

The PAO fluids may be conveniently made by the polymerization of an alphaolefin in the presence of a polymerization catalyst such as the Friedel-Crafts catalysts including, for example, aluminum trichloride, boron trifluoride or complexes of boron trifluoride with water, alcohols such as ethanol, propanol or butanol, carboxylic acids or esters such as ethyl acetate or ethyl propionate.

The hydrocarbyl aromatics can be used as base oil or base oil component and can be any hydrocarbyl molecule that contains at least about 5% of its weight derived from an aromatic moiety such as a benzenoid moiety or naphthenoid moiety, or their derivatives. These hydrocarbyl aromatics include alkyl benzenes, alkyl naphthalenes, alkyl diphenyl oxides, alkyl naphthols, alkyl diphenyl sulfides, alkylated bis-phenol A, alkylated thiodiphenol, and the like. The aromatic can be mono-alkylated, dialkylated, polyalkylated, and the like. The aromatic can be mono- or poly-functionalized. The hydrocarbyl groups can also be comprised of mixtures of alkyl groups, alkenyl groups, alkynyl, cycloalkyl groups, cycloalkenyl groups and other related hydrocarbyl groups. The hydrocarbyl groups can range from about $C_6$ up to about $C_{60}$ with a range of about $C_8$ to about $C_{20}$ being used in some embodiments. A mixture of hydrocarbyl groups may be used, and up to about three such substituents may be present. The hydrocarbyl group can optionally contain sulfur, oxygen, and/or nitrogen containing substituents. The aromatic group can also be derived from natural (petroleum) sources, provided at least about 5% of the molecule is comprised of an above-type aromatic moiety. Viscosities at 100° C. of approximately 3 cSt to about 50 cSt may be used, with viscosities of approximately 3.4 cSt to about 20 cSt being used in some embodiment for the hydrocarbyl aromatic component. In one embodiment, an alkyl naphthalene where the alkyl group is primarily comprised of 1-hexadecene is used. Other alkylates of aromatics can be advantageously used. Naphthalene or methyl naphthalene, for example, can be alkylated with olefins such as octene, decene, dodecene, tetradecene or higher, mixtures of similar olefins, and the like. Useful concentrations of hydrocarbyl aromatic in a lubricant oil composition can be about 2 wt % to about 25 wt %, or about 4 wt % to about 20 wt %, or about 4 wt % to about 15 wt %, depending on the application.

Esters comprise a useful base stock. Additive solvency and seal compatibility characteristics may be secured by the use of esters such as the esters of dibasic acids with monoalkanols and the polyol esters of monocarboxylic acids. Esters of the former type include, for example, the esters of dicarboxylic acids such as phthalic acid, succinic acid, alkyl succinic acid, alkenyl succinic acid, maleic acid, azelaic acid, suberic acid, sebacic acid, fumaric acid, adipic acid, linoleic acid dimer, malonic acid, alkyl malonic acid, alkenyl malonic acid, etc., with a variety of alcohols such as butyl alcohol, hexyl alcohol, dodecyl alcohol, 2-ethylhexyl alcohol, etc. Specific examples of these types of esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, etc.

Particularly useful synthetic esters are those which are obtained by reacting one or more polyhydric alcohols, including the hindered polyols (such as the neopentyl polyols, e.g., neopentyl glycol, trimethylol ethane, 2-methyl-2-propyl-1,3-propanediol, trimethylol propane, pentaerythritol and dipentaerythritol) with alkanoic acids containing at least about 4 carbon atoms, including $C_5$ to $C_{30}$ acids such as saturated straight chain fatty acids including caprylic acid, capric acid, lauric acid, myristic acid, palmitic acid, stearic acid, arachic acid, and behenic acid, or the corresponding branched chain fatty acids or unsaturated fatty acids such as oleic acid, or mixtures of any of these materials.

Suitable synthetic ester components include the esters of trimethylol propane, trimethylol butane, trimethylol ethane, pentaerythritol and/or dipentaerythritol with one or more monocarboxylic acids containing from about 5 to about 10 carbon atoms. These esters are widely available commercially, for example, the Mobil P-41 and P-51 esters of ExxonMobil Chemical Company).

Other useful fluids of lubricating viscosity include non-conventional or unconventional base stocks that have been processed, for example, catalytically, or synthesized to provide high performance lubrication characteristics.

Non-conventional or unconventional base stocks/base oils include one or more of a mixture of base stock(s) derived from one or more Gas-to-Liquids (GTL) materials, as well as isomerate/isodewaxate base stock(s) derived from natural wax or waxy feeds, mineral and or non-mineral oil waxy feed stocks such as slack waxes, natural waxes, and waxy stocks such as gas oils, waxy fuels hydrocracker bottoms, waxy raffinate, hydrocrackate, thermal crackates, or other mineral, mineral oil, or even non-petroleum oil derived waxy materials such as waxy materials received from coal liquefaction or shale oil, and mixtures of such base stocks.

GTL materials may derive from hydrogen-containing and carbon-containing compounds as feed stocks, from one or more transformation steps including, for example, synthesis, combination, transformation, rearrangement, or degradation/deconstructive processes. Gaseous feed stocks include, for example, hydrogen, water, carbon monoxide, carbon dioxide, methane, ethane, ethylene, acetylene, propane, propylene, propyne, butane, butylenes, and butynes. GTL base stocks are GTL materials of lubricating viscosity that are derived for example from hydrocarbons, particularly waxy synthesized hydrocarbons, and oxygenate analogues, produced from gaseous feed stocks, as discussed herein. GTL base stocks include oils boiling in the lube oil boiling range, having reduced pour point, that may be produced from (1) synthesized wax or waxy hydrocarbons, (2) synthesized GTL materials, (3) synthesized Fischer-Tropsch (F-T) materials (i.e., hydrocarbons, waxy hydrocarbons, waxes, and analogous oxygenates), using one or more of processes that include, for example, fractionation, distillation, catalytic dewaxing, solvent dewaxing, catalytic hydrocracking/hydroisomerization, and hydrofinishing. GTL materials, more particularly GTL base stocks, are preferably derived from F-T materials.

The base oil constitutes the major component of the engine oil lubricant composition of the present disclosure and typically is present in an amount ranging from about 50 to about 99 wt %, e.g., from 70 to 90 wt % or from about 85 to about 95 wt %, based on the total weight of the composition. The base oil may be selected from any of the synthetic or natural oils typically used as crankcase lubricating oils for spark-ignited and compression-ignited engines. Mixtures of synthetic and natural base oils may be used if desired. As used herein, the base stock name is associated with the D445 KV100 viscosity of the base stock. For instance, PAO 4 has a D445 100C viscosity of 4 cSt; GTL 3 has a D445 100C viscosity of 3 cSt.

In some embodiments, a PAO base oil may be included in the engine oil lubricant composition. For example, the PAO base oil may be included in an amount of about 50 wt % to 90 wt %, or about 60 wt % to about 80 wt %, or about 65 wt % to about 80 wt %, or about 69 wt % to about 76 wt % based on the total weight of the engine oil lubricant composition. The PAO base oil may have a Noack volatility of about 12.5% to about 15%. The PAO base oil may have KV100 at 100° C. of 5 cSt or less. In some embodiments, the PAO base oil may have a KV100 at 100° C. of about 1 cSt to about 5 cSt.

In some embodiments, a Group II base oil may be included in the engine oil lubricant composition. For example, the Group II base oil may be included in an amount of about 0.1 wt % to about 50 wt %, or about 5 wt % to about 20 wt %, or about 8 wt % to about 15 wt %, or about 9 wt % to about 12 wt % based on the total weight of the engine oil lubricant composition. In some embodiments, the Group II base oil may have a KV100 at 100° C. of from about 1 cSt to 8 cSt, or from about 2 cSt to about 6 cSt, or from about 1 cSt to about 3.7 cSt.

In some embodiments, a Group V base oil may be included in the engine oil compositions. For example, the Group V base oil may be included in the engine oil lubricant composition in an amount of about 0 wt % to 30 wt %, 0 wt % to 10 wt %, or from 0 wt % to 5 wt % based on the total weight of the engine oil lubricant composition. The Group V base oil may have a kinematic viscosity at 100° C. of from about 1 cSt to about 8 cSt, or about 2 cSt to about 6 cSt, or about 3 cSt to about 5 cSt.

Dispersants

At least one embodiment of the engine oil lubricant compositions may include a dispersant. During engine operation, oil-insoluble oxidation byproducts are produced. Dispersants help keep these byproducts in solution, thus diminishing their deposition on metal surfaces. Dispersants may be ashless or ash-forming in nature. So-called ashless dispersants are organic materials that form substantially no ash upon combustion. For example, non-metal-containing or borated metal-free dispersants are considered ashless. In contrast, metal-containing detergents discussed above form ash upon combustion.

Particular embodiments of the engine oil lubricant compositions may include succinimide dispersants. Succinimides are formed by the condensation reaction between hydrocarbyl substituted succinic anhydrides and amines. Succinimide dispersants are typically the imide formed from a polyamine, typically a poly(ethyleneamine). Molar ratios may vary depending on the polyamine. For example, the molar ratio of hydrocarbyl substituted succinic anhydride to TEPA may vary from 1:1 to 5:1. In an embodiment, useful dispersants include, for example, N-substituted hydrocarbyl-substituted succinimide dispersants (NSHS). In an embodiment, boron derivatives of amine-containing and polyamine-containing additives disclosed herein are suitably used with the invention of this disclosure.

In some embodiments, the succinimide dispersants may be borated or non-borated. For example, the succinimide dispersants can be borated with from about 0.1 moles to about 5 moles of boron per mole of dispersant reaction product. However, as previously described, embodiments may include succinimide dispersants to provide improved fuel efficiency as compared to borated succinimide dispersants.

In some embodiments, the succinimide dispersants may have a peak molecular weight selected, for example, to provide improved fuel efficiency. By inclusion of a succinimide dispersants with a lower peak molecular weight, the fuel efficiency of the engine oil lubricant compositions may be improved. In some embodiments, the succinimide dispersants may have a peak molecular weight of about 6000 or less, as determined using gel permeation chromatography with polystyrene calibration standard. For example, the succinimide dispersants may have a peak molecular weight of about 4000 to about 6000, as determined using gel permeation chromatography with polystyrene calibration standard.

The succinimide dispersants may be included in the engine oil lubricant composition in any suitable amount. For example, a particular succinimide dispersant may be included an amount of about 0.1 wt % to 20 wt % or about 0.5 wt % to about 8 wt % based on the total weight of the engine oil lubricant composition. In some embodiments, a combination of succinimide dispersants may be used.

In some embodiments, one or more additional dispersants may be included in the engine oil lubricant compositions. Typical dispersants include, but are not limited to, amines, alcohols, amides, or ester polar moieties attached to the polymer backbones via bridging groups. Ashless dispersants useful in specific embodiments may be selected, for example, from oil soluble salts, esters, amino-esters, amides, imides, and oxazolines of long chain hydrocarbon substituted mono and dicarboxylic acids or their anhydrides; thiocarboxylate derivatives of long chain hydrocarbons; long chain aliphatic hydrocarbons having a polyamine attached directly thereto; and Mannich condensation products formed by condensing a long chain substituted phenol with formaldehyde and polyalkylene-polyamine. Borated metal-free analogues of the ashless dispersants disclosed herein are also considered ashless. Nitrogen-containing ashless (metal-free) dispersants are basic, and contribute to the TBN of a lubricating oil composition to which they are added, without introducing additional sulfated ash. Many types of ashless dispersants are known in the art.

Suitable dispersant molecular structures for the additional dispersants typically contain a polar group attached to a relatively high molecular weight hydrocarbon chain. For example, ashless dispersants generally comprise an oil soluble polymeric hydrocarbon backbone having functional groups that are capable of associating with particles to be dispersed. The polar group typically contains at least one element of nitrogen, oxygen, or phosphorus, and may comprise, for example, salts, esters, amino-esters, amides, imides, oxazolines, polyamines, carboxylic acids, thiocarboxylates, and the like. Typical hydrocarbon chains contain 50 to 400 carbon atoms.

Where used, the additional dispersants may be included in the engine oil lubricant composition in any suitable amount. For example, an additional dispersant may be included an amount of about 0.1 wt % to 20 wt % or about 0.5 wt % to about 8 wt % based on the total weight of the engine oil lubricant composition.

Friction Modifier

At least one embodiment of the engine oil lubricant compositions may include a friction modifier. A friction modifier is any material or two or more materials that can alter the coefficient of friction of a surface lubricated by a lubricant or fluid containing such material(s). Friction modifiers, also known as friction modifiers, or lubricity agents or oiliness agents, and other such agents that change the ability of base oils, formulated lubricant compositions, or functional fluids, to modify the coefficient of friction of a lubricated surface may be effectively used in combination with the base oils or lubricant compositions of the present disclosure if desired. Friction modifiers that lower the coefficient of friction are particularly advantageous in combination with the base oils and lube compositions of this disclosure. Friction modifiers may include metal-containing compounds or materials as well as ashless compounds or materials, or mixtures thereof. Metal-containing friction modifiers may include metal salts or metal-ligand complexes where the metals may include alkali, alkaline earth, or transition group metals. Such metal-containing friction modifiers may also have low-ash characteristics. Transition metals may include Mo, Sb, Sn, Fe, Cu, Zn, and others. Such suitable ligands may include hydrocarbyl derivative of alcohols, polyols, glycerols, partial ester glycerols, thiols, carboxylates, carbamates, thiocarbamates, dithiocarbamates, phosphates, thiophosphates, dithiophosphates, amides, imides, amines, thiazoles, thiadiazoles, dithiazoles, diazoles, triazoles, and other polar molecular functional groups containing effective amounts of O, N, S, or P, individually or in combination.

Ashless friction modifiers can also be used. Suitable ashless friction modifiers may include hydroxyl-containing hydrocarbyl base oils, glycerides, partial glycerides, glyceride derivatives, fatty organic acids, fatty amines, and sulfurized fatty acids. Suitable ashless friction modifiers may also include lubricant materials that contain effective amounts of polar groups, for example, hydroxyl-containing hydrocarbyl base oils, glycerides, partial glycerides, glyceride derivatives, and the like. Polar groups in friction modifiers may include hydrocarbyl groups containing effective amounts of O, N, S, or P, individually or in combination. Other friction modifiers that may be particularly effective include, for example, salts (both ash-containing and ashless derivatives) of fatty acids, fatty alcohols, fatty amides, fatty esters, hydroxyl-containing carboxylates, and comparable synthetic long-chain hydrocarbyl acids, alcohols, amides, esters, hydroxy carboxylates, and the like. In some instances fatty organic acids, fatty amines, and sulfurized fatty acids may be used as suitable friction modifiers. In some instances, friction modifiers containing ethylene-oxide segments are effective.

Ashless friction modifiers may be or may include polymeric and/or non-polymeric molecules. A suitable polymeric friction modifier may have a weight average molecular weight (Mw) of 3,000 or more; 4,000 or more; 5,000 or more; 6,000 or more; 7,000 or more; 8,000 or more; 9,000 or more; 10,000 or more; 15,000 or more; 20,000 or more; 30,000 or more; 40,000 or more; or 45,000 or more. The Mw of suitable polymeric friction modifiers may also range from a low of about 3,000, about 4,000, or about 5,000 to a high of about 10,000; about 30,000, or about 50,000. The Mw of suitable polymeric friction modifiers may also range from about 3,000 to 15,000; about 4,000 to about 12,000; about 3,000 to about 9,000; about 3,000 to about 7,000. The Mw of suitable polymeric friction modifiers may also be about 3,000, about 4,000, about 5,000, about 6,000, about 7,000, about 8,000, or about 9,000. A particularly suitable polymeric friction modifier is or includes ethylene oxide (EtO).

A suitable non-polymeric friction modifier may be or may include a mixed glyceride ester of mostly C14, C16, and $C_{18}$ molecules. Each C14, C16, and $C_{18}$ molecule may be linear, branched or cyclic. A majority of the C14, C16, and $C_{18}$ molecules are linear and are completely saturated. The mixed glyceride ester may be a mix of monoglycerides, diglycerides and triglycerides.

One or more friction modifiers may be included in the engine oil lubricant composition at a concentration of from 0.1 to 5 wt %, or 0.1 to 6 wt %, or 0.1 to 8 wt %, or 0.5 to 10 wt %, or 0.01 to 2 wt %, or 1.0 to 7.5 wt %, or 1.5 to 5 wt %. The at least one friction modifier may also be included in the engine oil lubricant composition at a concentration ranging from a low of about 0.1 wt %, about 0.3 wt %, or about 0.5 wt % to a high of about 5 wt %, about 10 wt %, or about 16 wt %. The at least one friction modifier concentration may also range from a low of about 0.1 wt %, about 0.5 wt %, or about 1.0 wt % to a high of about 5 wt %, about 8 wt %, or about 10 wt %. The foregoing friction modifier concentrations are based on the total weight of the engine oil lubricant composition.

Other Additives

The engine oil lubricant composition may also include one or more other additives typical for engine oils. These other additives may include any one or more viscosity modifiers, anti-wear additives, detergents, antioxidants, pour point depressant, corrosion inhibitors, anti-rust additives, metal deactivators, seal compatibility additives, and anti-foam agents. These other additives may be provided to the lubricant composition in the form of an additive package. The additive packages may be incorporated into the engine lubricant compositions at loadings of about 9 wt % to about 15 wt %, or about 10 to about 14.5 wt %, or about 11 wt % to about 14 wt %, based on the total weight of the composition. The additive packages may also be incorporated into the engine lubricant compositions at loadings ranging from a low of about 5 wt %, about 7 wt %, about 9 wt %, or about 10 wt % to a high of about 11 wt %, about 14 wt %, about 14.5 wt %, or about 15 wt %, based on the total weight of the composition.

Viscosity Modifiers (VM)

Viscosity modifiers are also known as VI improvers, viscosity index improvers and viscosity improvers. Suitable viscosity modifiers provide lubricants with high temperature and low temperature operability. Suitable viscosity modifiers also impart shear stability at elevated temperatures and acceptable viscosity at low temperatures. Suitable viscosity modifiers may be or may include one or more linear or star-shaped polymers and/or copolymers of methacrylate, butadiene, olefins, isoprene or alkylated styrenes, polyisobutylene, polymethacrylate, ethylene-propylene, hydrogenated block copolymer of styrene and isoprene, polyacrylates, styrene-isoprene block copolymer, styrene-butadiene copolymer, ethylene-propylene copolymer, hydrogenated star polyisoprene, and combinations thereof.

As used herein, the term "polymer" refers to any two or more of the same or different repeating units. The term "homopolymer" refers to a polymer having units that are the same. The term "copolymer" refers to a polymer having two or more units that are different from each other, and includes terpolymers and the like. The term "terpolymer" refers to a polymer having three units that are different from each other. The term "different" refers to units indicates that the units differ from each other by at least one atom or are different isomerically. Likewise, the definition of polymer, as used herein, includes homopolymers, copolymers, and the like. Furthermore, the term "styrenic block copolymer" refers to any copolymer that includes units of styrene and a mid-block.

Suitable olefin copolymers, for example, are commercially available from Chevron Oronite Company LLC under the trade designation "PARATONE®" (such as "PARATONE® 8921" and "PARATONE® 8941"); from Afton Chemical Corporation under the trade designation "HiTEC®" (such as "HiTEC® 5850B"; and from The Lubrizol Corporation under the trade designation "Lubrizol® 7067C". Suitable polyisoprene polymers, for example, are commercially available from Infineum International Limited, e.g. under the trade designation "SV200". Suitable diene-styrene copolymers, for example, are commercially available from Infineum International Limited, e.g. under the trade designation "SV 260".

One particularly suitable viscosity modifier is polyisobutylene. Another particularly suitable viscosity modifier is polymethacrylate, which can also serve as pour point depressant. Other particularly suitable viscosity modifiers include copolymers of ethylene and propylene, hydrogenated block copolymers of styrene and isoprene, and polyacrylates. Specific examples include styrene-isoprene and styrene-butadiene based polymers of 50,000 to 200,000 molecular weight.

Suitable viscosity modifiers may further include high molecular weight hydrocarbons, polyesters and dispersants that function as both a viscosity modifier and a dispersant. Typical molecular weights of these polymers may range between about 10,000 and about 2,000,000, more typically about 20,000 and about 1,500,000, and even more typically between about 50,000 and about 1,200,000.

The at least one viscosity modifier may be included in the engine oil lubricant composition at a concentration of about 0.1 wt % to about 5 wt %, or about 0.1 wt % to about 8 wt %, or about 0.1 wt % to about 14 wt %, or about 0.5 wt % to about 10 wt %, or about 0.01 wt % to 2 about wt %, or about 1.0 wt % to about 7.5 wt %, or about 1.5 wt % to about 5 wt %. The at least one viscosity modifier may also be included in the engine oil lubricant composition at a concentration ranging from a low of about 0.1 wt %, about 0.3 wt %, or about 0.5 wt % to a high of about 5 wt %, about 8 wt %, or about 16 wt %. The at least one viscosity modifier concentration may also range from a low of about 0.1 wt %, about 0.5 wt %, or about 1.0 wt % to a high of about 8 wt %, about 12 wt %, or about 14 wt %. The foregoing viscosity modifier concentrations are based on a polymer concentrate basis in terms of the total weight of the lubricant composition.

Antiwear

While there are many different types of antiwear additives, for several decades the principal antiwear additive for internal combustion engine crankcase oils is a metal alkylthiophosphate and more particularly a metal dialkyldithiophosphate in which the metal constituent is zinc, or zinc dialkyldithiophosphate (ZDDP). ZDDP can be primary, secondary or mixtures thereof. ZDDP compounds generally are of the formula $Zn[SP(S)(OR^1)(OR^2)]_2$ where $R^1$ and $R^2$ are $C_1$-$C_{18}$ alkyl groups, such as $C_2$-$C_{12}$ alkyl groups. These alkyl groups may be straight chain or branched. The ZDDP is typically used in amounts of about 0.4 wt % to 1.4 wt % of the total lubricant oil composition, although more or less can often be used advantageously. In some embodiments, the ZDDP is a secondary ZDDP and present in an amount of about 0.6 wt % to 1.0 wt %, or about 0.6 wt % to 0.91 wt % of the total lubricant composition.

Examples of suitable zinc dithiophosphates which are commercially available include secondary zinc dithiophosphates such as those available from for example, The Lubrizol Corporation under the trade designations "LZ 677A", "LZ 1095" and "LZ 1371", from for example Chevron Oronite under the trade designation "OLOA 262" and from for example Afton Chemical under the trade designation "HITEC 7169".

Detergents

Detergents are commonly used in lubricant compositions. A typical detergent is an anionic material that contains a long chain hydrophobic portion of the molecule and a smaller anionic or oleophobic hydrophilic portion of the molecule. The anionic portion of the detergent is typically derived from an organic acid such as a sulfur acid, carboxylic acid, phosphorous acid, phenol, or mixtures thereof. The counterion is typically an alkaline earth or alkali metal.

Salts that contain a substantially stochiometric amount of the metal are described as neutral salts and have a total base number (TBN, as measured by ASTM D2896) of from 0 to 80. Many compositions are overbased, containing large amounts of a metal base that is achieved by reacting an excess of a metal compound (a metal hydroxide or oxide, for example) with an acidic gas (such as carbon dioxide). Useful detergents can be neutral, mildly overbased, or highly overbased.

It is desirable for at least some detergent to be overbased. Overbased detergents help neutralize acidic impurities produced by the combustion process and become entrapped in the oil. Typically, the overbased material has a ratio of metallic ion to anionic portion of the detergent of about 1.05:1 to 50:1 on an equivalent basis. By way of further example, the ratio is from about 4:1 to about 25:1. The resulting detergent is an overbased detergent that will typically have a TBN of about 150 or higher, often about 250 to 450 or more. In some embodiments, the overbasing cation is sodium, calcium, or magnesium. A mixture of detergents of differing TBN can be used in the present disclosure.

Examples of suitable detergents may include the alkali or alkaline earth metal salts of sulfonates, phenates, carboxylates, phosphates, and salicylates.

Sulfonates may be prepared from sulfonic acids that are typically obtained by sulfonation of alkyl substituted aromatic hydrocarbons. Hydrocarbon examples include those obtained by alkylating benzene, toluene, xylene, naphthalene, biphenyl and their halogenated derivatives (chlorobenzene, chlorotoluene, and chloronaphthalene, for example). The alkylating agents typically have about 3 carbon atoms to 70 carbon atoms. The alkaryl sulfonates typically contain about 9 carbon atoms to about 80 carbon or more carbon atoms, more typically from about 16 carbon atoms to 60 carbon atoms.

Alkaline earth phenates are another useful class of detergent. These detergents can be made by reacting alkaline earth metal hydroxide or oxide ($CaO$, $Ca(OH)_2$, $BaO$, $Ba(OH)_2$, $MgO$, $Mg(OH)_2$, for example) with an alkyl phenol or sulfurized alkylphenol. Useful alkyl groups include straight chain or branched $C_1$-$C_{30}$ alkyl groups, such as, $C_4$-$C_{20}$. Examples of suitable phenols include isobutylphenol, 2-ethylhexylphenol, nonylphenol, dodecyl phenol, and the like. It should be noted that starting alkylphenols may contain more than one alkyl substituent that are each independently straight chain or branched. When a non-sulfurized alkylphenol is used, the sulfurized product may be obtained by methods well known in the art. These methods include heating a mixture of alkylphenol and sulfurizing agent (including elemental sulfur, sulfur halides such as sulfur dichloride, and the like) and then reacting the sulfurized phenol with an alkaline earth metal base.

Metal salts of carboxylic acids are also useful as detergents. These carboxylic acid detergents may be prepared by reacting a basic metal compound with at least one carboxylic acid and removing free water from the reaction product. These compounds may be overbased to produce the desired TBN level. Detergents made from salicylic acid are one example class of detergents derived from carboxylic acids. Useful salicylates include long chain alkyl salicylates. One useful family of compositions is of the formula

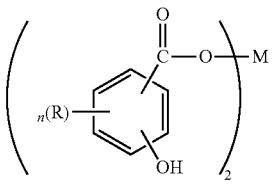

where R is a hydrogen atom or an alkyl group having 1 to about 30 carbon atoms, n is an integer from 1 to 4, and M is an alkaline earth metal. Example R groups are alkyl chains of at least $C_{11}$, for example, $C_{13}$ or greater. R may be optionally substituted with substituents that do not interfere with the detergent's function. M is, in some embodiments, calcium, magnesium, or barium.

Hydrocarbyl-substituted salicylic acids may be prepared from phenols by the Kolbe reaction. The metal salts of the hydrocarbyl-substituted salicylic acids may be prepared by double decomposition of a metal salt in a polar solvent such as water or alcohol.

Alkaline earth metal phosphates may also be used as detergents.

Detergents may be simple detergents or what is known as hybrid or complex detergents. The latter detergents can provide the properties of two detergents without the need to blend separate materials.

Examples of suitable detergents may include calcium phenates, calcium sulfonates, calcium salicylates, magnesium phenates, magnesium sulfonates, magnesium salicylates and other related components (including borated detergents). Typically, the total detergent concentration is about 0.01 wt % to about 6.0 wt %, or about 0.01 wt % to about 4 wt %, or about 0.01 wt % to about 3 wt %, or about 0.01 wt % to about 2.2 wt %, or about 0.01 wt % to about 1.5 wt %, or about 0.1 wt % to about 3.5 wt %.

Antioxidants

Antioxidants retard the oxidative degradation of base oils during service. Such degradation may result in deposits on metal surfaces, the presence of sludge, or a viscosity increase in the lubricant. One skilled in the art knows a wide variety of oxidation inhibitors that are useful in lubricating oil compositions.

Useful antioxidants may include hindered phenols. These phenolic antioxidants may be ashless (metal-free) phenolic compounds or neutral or basic metal salts of certain phenolic compounds. Typical phenolic antioxidant compounds are the hindered phenolics which are the ones which contain a sterically hindered hydroxyl group, and these include those derivatives of dihydroxy aryl compounds in which the hydroxyl groups are in the o- or p-position to each other. Typical phenolic antioxidants include the hindered phenols substituted with $C_6$+ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; and 2-methyl-6-t-butyl-4-dodecyl phenol. Other useful hindered mono-phenolic antioxidants may include for example hindered 2,6-di-alkyl-phenolic proprionic ester derivatives. Bis-phenolic antioxidants may also be advantageously used in combination with the some embodiments of the engine oil lubricant compositions. Examples of ortho-coupled phenols include: 2,2'-bis(4-heptyl-6-t-butyl-phenol); 2,2'-bis(4-octyl-6-t-butyl-phenol); and 2,2'-bis(4-dodecyl-6-t-butyl-phenol). Para-coupled bisphenols include for example 4,4'-bis(2,6-di-t-butyl phenol) and 4,4'-methylene-bis(2,6-di-t-butyl phenol).

Non-phenolic oxidation inhibitors which may be used include aromatic amine antioxidants and these may be used either as such or in combination with phenolics. Typical examples of non-phenolic antioxidants include: alkylated and non-alkylated aromatic amines such as aromatic monoamines of the formula $R^8R^9R^{10}N$ where $R^8$ is an aliphatic, aromatic or substituted aromatic group, $R^9$ is an aromatic or a substituted aromatic group, and $R^{10}$ is H, alkyl, aryl or $R_{11}S(O)_xR^{12}$ where $R^{11}$ is an alkylene, alkenylene, or aralkylene group, $R^{12}$ is a higher alkyl group, or an alkenyl, aryl, or alkaryl group, and x is 0, 1 or 2. The aliphatic group $R^8$ may contain 1 to 20 carbon atoms, for example, 6 to 12 carbon atoms. The aliphatic group is a saturated aliphatic group. In some embodiments, both $R^8$ and $R^9$ are aromatic or substituted aromatic groups, and the aromatic group may be a fused ring aromatic group such as naphthyl. Aromatic groups $R^8$ and $R^9$ may be joined together with other groups such as S.

Typical aromatic amines antioxidants have alkyl substituent groups of at least about 6 carbon atoms. Examples of aliphatic groups include hexyl, heptyl, octyl, nonyl, and decyl. Generally, the aliphatic groups will not contain more than about 14 carbon atoms. The general types of amine antioxidants useful in the present compositions include diphenylamines, phenyl naphthylamines, phenothiazines, imidodibenzyls and diphenyl phenylene diamines. Mixtures of two or more aromatic amines are also useful. Polymeric amine antioxidants can also be used. Particular examples of aromatic amine antioxidants useful in some embodiments include: p,p'-dioctyldiphenylamine; t-octylphenyl-alpha-naphthylamine; phenyl-alphanaphthylamine; and p-octylphenyl-alpha-naphthylamine. Sulfurized alkyl phenols and alkali or alkaline earth metal salts thereof may also be useful antioxidants.

Example antioxidants may include hindered phenols, arylamines. These antioxidants may be used individually by type or in combination with one another.

Antioxidants may be used in an amount of about 0.01 wt % to about 5 wt %, or about 0.01 wt % to 1.5 wt %, or zero to less 1.5 wt %, for example, zero, based on the total weight of the engine oil lubricant composition.

Pour Point Depressants

Conventional pour point depressants (also known as lube oil flow improvers) may be added to the compositions of the present disclosure if desired. These pour point depressant may be added to lubricant compositions of the present disclosure to lower the minimum temperature at which the fluid will flow or can be poured. Examples of suitable pour point depressants include polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. Such additives may be used in an amount of about 0.01 wt % to 5 wt %, or about 0.01 wt % to 1.5 wt %, based on the total weight of the engine oil lubricant composition.

Corrosion Inhibitor

One or more corrosion inhibitors may be added to the lubricating oil compositions. Corrosion inhibitors are additives that protect lubricated metal surfaces against chemical attack by water or other contaminants. Corrosion inhibitors may also be used to reduce the degradation of metallic parts that are in contact with the lubricating oil composition. As used herein, corrosion inhibitors include anti-rust additives, metal deactivators, and metal passivators.

One type of corrosion inhibitor is a polar compound that wets the metal surface for example, protecting it with a film of oil. Another type of corrosion inhibitor absorbs water by incorporating it in a water-in-oil emulsion so that only oil touches the metal surface. Yet another type of corrosion inhibitor chemically adheres to the metal to produce a non-reactive surface. Suitable corrosion inhibitors include zinc dithiophosphates, metal phenolates, basic metal sulfonates, fatty acids and amines. Other suitable corrosion inhibitors include, for example, aryl thiazines, alkyl substituted dimercaptothiodiazoles, alkyl substituted dimercaptothiadiazoles, thiazoles, triazoles, non-ionic polyoxyalkylene polyols and esters thereof, polyoxyalkylene phenols, anionic alkyl sulfonic acids, and the like, and mixtures thereof.

Illustrative corrosion inhibitors may include, for example, (short-chain) alkenyl succinic acids, partial esters thereof and nitrogen-containing derivatives thereof; and petroleum sulfonates, synthetic sulfonates, synthetic alkarylsulfonates, such as metal alkylbenzene sulfonates, and metal dinonylnaphthalene sulfonates. Corrosion inhibitors also include, for example, monocarboxylic acids which have from 8 to 30 carbon atoms, alkyl or alkenyl succinates or partial esters thereof, hydroxy-fatty acids which have from 12 to 30 carbon atoms and derivatives thereof, sarcosines which have from 8 to 24 carbon atoms and derivatives thereof, amino acids and derivatives thereof, naphthenic acid and derivatives thereof, lanolin fatty acid, mercapto-fatty acids and paraffin oxides.

Examples of particular corrosion inhibitors include monocarboxylic acids ($C_8$-$C_{30}$), caprylic acid, pelargonic acid, decanoic acid, undecanoic acid, lauric acid, myristic acid, palmitic acid, stearic acid, arachic acid, behenic acid, cerotic acid, montanic acid, melissic acid, oleic acid, docosanic acid, erucic acid, eicosenic acid, beef tallow fatty acid, soy bean fatty acid, coconut oil fatty acid, linolic acid, linoleic acid, tall oil fatty acid, 12-hydroxystearic acid, laurylsarcosinic acid, myritsylsarcosinic acid, palmitylsarcosinic acid, stearylsarcosinic acid, oleylsarcosinic acid, alkylated ($C_8$-$C_{20}$) phenoxyacetic acids, lanolin fatty acid and $C_8$-$C_{24}$ mercapto-fatty acids.

Examples of polybasic carboxylic acids which function as corrosion inhibitors include alkenyl ($C_{10}$-$C_{100}$) succinic acids and ester derivatives thereof, dimer acid, N-acyl-N-alkyloxyalkyl aspartic acid esters. Examples of the alkylamines which function as corrosion inhibitors or as reaction products with the above carboxylates to give amides and the like are represented by primary amines such as laurylamine, coconut-amine, n-tridecylamine, myristylamine, n-pentadecylamine, palmitylamine, n-heptadecylamine, stearylamine, n-nonadecylamine, n-eicosylamine, n-heneicosylamine, n-docosylamine, n-tricosylamine, n-pentacosylamine, oleylamine, beef tallow-amine, hydrogenated beef tallow-amine and soy bean-amine. Examples of the secondary amines include dilaurylamine, di-coconut-amine, di-n-tri decyl amine, dimyristylamine, di-n-pentadecylamine, dipalmitylamine, di-n-pentadecylamine, distearylamine, di-n-nonadecylamine, di-n-eicosylamine, di-n-heneicosylamine, di-n-docosylamine, di-n-tricosylamine, di-n-pentacosyl-amine, dioleylamine, di-beef tallow-amine, di-hydrogenated beef tallow-amine and di-soy bean-amine. Examples of the aforementioned alkylenediamines, alkylated alkylenediamines, and N-alkylpolyalkyenediamines include: ethylenediamines such as laurylethylenediamine, coconut ethylenediamine, n-tridecylethylenediamine-, myristylethylenediamine, n-pentadecylethylenediamine, palmitylethylenediamine, n-heptadecylethylenediamine, stearylethylenediamine, n-nonadecylethylenediamine, n-eicosylethylenediamine, n-heneicosylethylenediamine, n-docosylethylendiamine, n-tricosylethylenediamine, n-pentacosylethylenediamine, oleylethylenediamine, beef tallow-ethylenediamine, hydrogenated beef tallow-ethylenediamine and soy bean-ethylenediamine; propylenediamines such as laurylpropylenediamine, coconut propylenediamine, n-tridecylpropylenediamine, myristylpropylenediamine, n-pentadecylpropylenediamine, palmitylpropylenediamine, n-heptadecylpropylenediamine, stearylpropylenediamine, n-nonadecylpropylenediamine, n-eicosylpropylenediamine, n-heneicosylpropylenediamine, n-docosylpropylendiamine, n-tricosylpropylenediamine, n-pentacosylpropylenediamine, diethylene triamine (DETA) or triethylene tetramine (TETA), oleylpropylenediamine, beef tallow-propylenediamine, hydrogenated beef tallow-propylenediamine and soy bean-propylenediamine; butylenediamines such as laurylbutylenediamine, coconut butylenediamine, n-tridecylbutylenediamine-myristylbutylenediamine, n-pentadecylbutylenediamine, stearylbutylenediamine, n-eicosylbutylenediamine, n-heneicosylbutylenedia-mine, n-docosylbutylendiamine, n-tricosylbutylenediamine, n-pentacosylbutylenediamine, oleylbutylenediamine, beef tallow-butylenediamine, hydrogenated beef tallow-butylenediamine and soy bean butylenediamine; and pentylenediamines such as laurylpentylenediamine, coconut pentylenediamine, myristylpentylenediamine, palmitylpentylenediamine, stearylpentylenediamine, oleyl-pentylenediamine, beef tallow-pentylenediamine, hydrogenated beef tallow-pentylenediamine and soy bean pentylenediamine.

Other illustrative corrosion inhibitors include 2,5-dimercapto-1,3,4-thiadiazoles and derivatives thereof, mercaptobenzothiazoles, alkyltriazoles and benzotriazoles. Examples of dibasic acids useful as corrosion inhibitors, which are used in the present disclosure, are sebacic acid, adipic acid, azelaic acid, dodecanedioic acid, 3-methyladipic acid, 3-nitrophthalic acid, 1,10-decanedicarboxylic acid, and fumaric acid. The corrosion inhibitors may be a straight or branch-chained, saturated or unsaturated monocarboxylic acid or ester thereof which are optionally sulfurized in an amount up to 35 wt %. In some embodiments, the acid is a $C_4$ to $C_{22}$ straight chain unsaturated monocarboxylic acid. In some embodiments, the concentration of this additive is about 0.001 wt % to about 0.35 wt % based on a total weight of the engine oil lubricant composition. An example monocarboxylic acid is sulfurized oleic acid. Alternatively, other suitable materials include oleic acid itself, valeric acid and erucic acid. An illustrative corrosion inhibitor includes a triazole as previously defined. The triazole should be used at a concentration of about 0.005 wt % to about 0.25 wt % based on a total weight of the engine oil lubricant composition. An example triazole is tolylotriazole which is suitably included in the compositions of the disclosure. Also suitably included in compositions are triazoles, thiazoles and certain diamine compounds which are useful as metal deactivators or metal passivators. Examples include triazole, benzotriazole and substituted benzotriazoles such as alkyl substituted derivatives. The alkyl substituent generally contains up to 15 carbon atoms, for example, up to 8 carbon atoms. The triazoles optionally contain other substituents on the aromatic ring such as halogens, nitro, amino, mercapto, etc. Examples of suitable compounds are benzotriazole and the tolyltriazoles, ethylbenzotriazoles, hexylbenzotriazoles, octylbenzotriazoles, chlorobenzotriazoles and nitrobenzotriazoles. Benzotriazole and tolyltriazole may be used in some embodiments. A straight or branched chain saturated or unsaturated monocarboxylic acid which is optionally sulfurized in an amount which is up to 35 wt %; or an ester of such an acid; and a triazole or alkyl derivatives thereof, or short chain alkyl of up to 5 carbon atoms; n is zero or an integer between 1 and 3 inclusive; and is hydrogen, morpholino, alkyl, amido, amino, hydroxy or alkyl or aryl substituted derivatives thereof; or a triazole selected from 1,2,4 triazole, 1,2,3 triazole, 5-anilo-1,2,3,4-thiatriazole, 3-amino-1,2,4 triazole, 1-H-benzotriazole-1-yl-methylisocyanide, methylene-bis-benzotriazole and naphthotriazole.

Other illustrative corrosion inhibitors may include 2-mercaptobenzothiazole, dialkyl-2,5-dimercapto-1,3,4-thiadiazole; N,N'-disalicylideneethylenediamine, N,N'-disalicylidenepropylenediamine, N-salicylideneethylamine, N,N'-disalicylideneethyldiamine; triethylenediamine, ethylenediaminetetraacetic acid; zinc dialkyldithiophosphates and dialkyl dithiocarbamates, and the like.

Other illustrative corrosion inhibitors may include a yellow metal passivator. The term "yellow metal" refers to a metallurgical grouping that includes, for example, brass and bronze alloys, aluminum bronze, phosphor bronze, copper, copper nickel alloys, and beryllium copper, and the like. Typical yellow metal passivators include, for example, benzotriazole, tolutriazole, tolyltriazole, mixtures of sodium tolutriazole and tolyltriazole, imidazole, benzimidazole, imidazoline, pyrimidine, and derivatives thereof, and combinations thereof. In one particular and non-limiting embodiment, a compound containing tolyltriazole is selected.

The one or more metal corrosion inhibitors may be present in amounts of about 0.01 wt % to about 5.0 wt %, or about 0.01 wt % to about 3.0 wt %, or about 0.01 wt % to about 1.5 wt %, based on the total weight of the engine oil lubricant composition.

Seal Compatibility Agents

Seal compatibility agents help to swell elastomeric seals by causing a chemical reaction in the fluid or physical change in the elastomer. Suitable seal compatibility agents for lubricating oils include organic phosphates, aromatic esters, aromatic hydrocarbons, esters (butylbenzyl phthalate, for example), and polybutenyl succinic anhydride. Such additives may be used in an amount of about 0.01 wt % to about 3 wt %, or about 0.01 wt % to 2 about wt %, based on the total weight of the engine oil lubricant composition.

Anti-Foam

Anti-foam agents may advantageously be added to lubricant compositions. These agents retard the formation of stable foams. Silicones and organic polymers are typical anti-foam agents. For example, polysiloxanes, such as silicon oil or polydimethyl siloxane, provide antifoam properties. Anti-foam agents are commercially available and may be used in conventional minor amounts along with other additives such as demulsifiers; usually the amount of these additives combined is less than 1 weight percent and often less than 0.1 wt %, based on the total weight of the engine oil lubricant composition.

When lubricating oil compositions contain any one or more of the additives discussed above, the additive(s) are blended into the composition in an amount sufficient for it to perform its intended function. Illustrative amounts of such additives that can be used in the engine oil lubricants described herein are shown in Table 1 below.

Note that many of the additives are shipped from the manufacturer and used with a certain amount of base oil diluent in the formulation. Accordingly, the weight amounts in Table 2, as well as other amounts mentioned in this specification, are directed to the amount of active ingredient (that is the non-diluent portion of the ingredient). The wt % indicated below are based on the total weight of the lubricating oil composition.

TABLE 2

Typical Amounts of Various Lubricant Oil Components

| Compound | Approximate wt % (Useful) | Approximate wt % (Exemplary) |
|---|---|---|
| Detergent | 0.01-6 | 0.01-4 |
| Dispersant | 0.1-20 | 0.1-8 |
| Friction Modifier | 0.01-5 | 0.01-1.5 |
| Viscosity Modifier (solid polymer basis) | 0.1-8 | 0.1-6 |
| Antioxidant | 0.1-5 | 0.1-2.0 |
| Anti-wear Additive | 0.01-6 | 0.01-4 |
| Pour Point Depressant | 0.0-5 | 0.01-1.5 |
| Anti-foam Agent | 0.001-3 | 0.001-0.15 |
| Base stock or base oil | Balance | Balance |

The foregoing additives may be added independently or may be pre-combined in packages which can be obtained from suppliers of lubricant oil additives. Additive packages with a variety of ingredients, proportions and characteristics are available and selection of the appropriate package will take the requisite use of the ultimate composition into account. The additive package may be incorporated into the engine oil lubricant compositions at loadings of about 9 wt % to about 15 wt %, or about 10 wt % to about 14.5 wt %, or about 11 wt % to about 14 wt %, based on the total weight of the lubricant composition.

Accordingly, the preceding description describes engine oil lubricants compositions and methods for making same useful for gasoline and diesel engines and can provide excellent fuel efficiency. The foregoing engine oil lubricant compositions can further include any one or more of the following embodiments:

Embodiment 1. An engine oil lubricant composition comprising a polyalpha olefin base oil component an amount of about 50 wt % to about 90 wt % based on a total weight of the engine oil lubricant composition, wherein the polyalpha olefin base oil component is a Group IV base oil and has a Noack volatility of about 12.5% to about 15%. The engine oil lubricant composition further comprises a Group II base oil component in an amount of about 0.1 wt % to about 50 wt % based on the total weight of the engine oil lubricant composition. The engine oil lubricant composition has a kinematic viscosity at 100° C. of about 10 cSt or less. The engine oil lubricant composition further has a high temperature high shear viscosity at 150° C. of about 2.2 cP or less. The engine oil lubricant composition further has a Noack volatility of about 20% or less.

Embodiment 2. The engine oil lubricant composition of embodiment 1, wherein the polyalpha olefin base oil component has a kinematic viscosity at 100° C. of about 5 cSt or less.

Embodiment 3. The engine oil lubricant composition of embodiment 1 or embodiment 2, wherein the polyalpha olefin base oil component is present in an amount of about 52 wt % to about 70 wt % based on the total weight of the engine oil lubricant composition.

Embodiment 4. The engine oil lubricant composition of any one of embodiments 1-3, wherein the Group II base oil component comprises a gas to liquids base stock.

Embodiment 5. The engine oil lubricant composition of any one of embodiments 1-4, wherein the Group II base oil component is present in an amount of about 8 wt % to about 29 wt % based on the total weight of the engine oil lubricant composition.

Embodiment 6. The engine oil lubricant composition of any one of embodiments 1-5, wherein the Group II base oil component has a kinematic viscosity at 100° C. of from about 2 cSt to about 6 cSt.

Embodiment 7. The engine oil lubricant composition of any one of embodiments 1-6, wherein the polyalpha olefin base stock is present in an amount of about 52 wt % to about 70 wt %, and wherein the Group II base oil component is present in an amount of about 8 wt % to about 29 wt % and comprises a gas to liquids base stock.

Embodiment 8. The engine oil lubricant composition of any one of embodiments 1-7 further comprising about 1 wt % to about 3 wt % of a Group V base oil component based on the total weight of the engine oil lubricant composition.

Embodiment 9. The engine oil lubricant composition of any one of embodiments 1-8, wherein the Group V base oil component has a kinematic viscosity at 100° C. of from 2 to 6 cSt.

Embodiment 10. The engine oil lubricant composition of any one of embodiments 1-8 further comprising a succinimide dispersant and a friction modifier.

Embodiment 11. The engine oil lubricant composition of embodiment 10, wherein the succinimide dispersant is non-borated and is present in an amount of about 0.1 wt % to about 8 wt % based on the total weight of the engine oil lubricant composition.

Embodiment 12. The engine oil lubricant composition of embodiment 10, wherein the friction modifier comprises a polymeric ethylene oxide friction modifier in an amount of about 0.1 wt % to about 5.0 wt % based on the total weight of the engine oil lubricant composition.

Embodiment 13. The engine oil lubricant composition of embodiment 10, wherein the succinimide dispersant has a peak molecular of about 6000 or less as determined using gel permeation chromatography with polystyrene calibration standard.

Embodiment 14. The engine oil lubricant composition of any one of embodiments 1-13 further comprising at least one additive selected from the group consisting of an anti-wear additives, a viscosity modifier, an antioxidant, a detergent, a pour point depressant, a corrosion inhibitor, a metal deactivator, a seal compatibility additive, an anti-foam agent, an inhibitor, an anti-rust additive, and any combination thereof.

Embodiment 15. An engine oil lubricant composition comprising a polyalpha olefin base oil component in an amount of about 52 wt % to about 70 wt % based on a total weight of the engine oil lubricant composition, wherein the polyalpha olefin base oil component is a Group IV base oil and has a Noack volatility of about 12.5% to about 15%. The engine oil lubricant composition further comprises a gas to liquids base oil component in an amount of about 8 wt % to about 29 wt % based on the total weight of the engine oil lubricant composition. The engine oil lubricant composition further comprises a first succinimide dispersant that is non-borated and is present in an amount of about 0.1 wt % to about 8 wt % based on the total weight of the engine oil lubricant composition. The engine oil lubricant composition further comprises a second succinimide dispersant in an amount of about 0.1 wt % to about 8 wt %, based on the total weight of the engine oil lubricant composition, wherein the second succinimide dispersant has a peak molecular weight of about 4000 to about 6000, as determined using gel permeation chromatography with polystyrene calibration standard. The engine oil lubricant composition further comprises a polymeric ethylene oxide friction modifier in an amount of about 0.1 wt % to about 5.0 wt % based on the total weight of the engine oil lubricant composition. The engine oil lubricant composition further has a kinematic viscosity at 100° C. of about 4 cSt or less. The engine oil lubricant composition further has a high temperature high shear viscosity at 150° C. of about 2.2 cP or less. The engine oil lubricant composition further has a Noack volatility of about 10% to about 18%.

Embodiment 16. The engine oil lubricant composition of embodiment 15, wherein the polyalpha olefin base oil component has a kinematic viscosity at 100° C. of about 5 cSt or less.

Embodiment 17. The engine oil lubricant composition of embodiment 15 or embodiment 16, wherein the polyalpha olefin base stock is present in an amount of about 60 wt % to about 70 wt %, and wherein the gas to liquids base oil component is present in an amount of about 10 wt % to about 15 wt %.

Embodiment 18. The engine oil lubricant composition of claim 15 or embodiment 16 wherein the polyalpha olefin base oil component is present in an amount of about 69 wt % to about 76 wt % based on the total weight of the engine oil lubricant composition, and wherein the Group II base oil component is present in an amount of about 9 wt % to about 12 wt % based on the total weight of the engine oil lubricant composition.

Embodiment 19. The engine oil lubricant composition of any one of embodiments 15-18, wherein the Group II base oil component has a kinematic viscosity at 100° C. of from about 2 cSt to about 6 cSt.

Embodiment 20. The engine oil lubricant composition of any one of embodiments 15-19 further comprising about 1 wt % to about 3 wt % of a Group V base oil component, based on the total weight of the engine oil lubricant composition, wherein the Group V base oil component has a kinematic viscosity at 100° C. of from 2 to 6 cSt.

EXAMPLES

To facilitate a better understanding of the present disclosure, the following examples of certain aspects of some embodiments are given. In no way should the following examples be read to limit, or define, the entire scope of the disclosure.

Example 1

Six engine oil lubricant compositions of various composition were tested and evaluated for viscosity, fuel economy, and Noack volatility. To get a sufficient fuel economy, a final result of ≥2.25% on the fuel economy test is desirable. Table 3 reports the lubricant formulations for each example. The values reported in Table 3 are wt % based on the total weight of the engine oil lubricant composition. The example lubricant compositions are identified as Sample 1-6.

TABLE 3

| Sample Lubricant Compositions | | | | | | |
|---|---|---|---|---|---|---|
| | 1 | 2 | 3 | 4 | 5 | 6 |
| PAO 3.6 Base Stock | 69.02 | 69.52 | 70.02 | 69.72 | 69.72 | 75.37 |
| PAO 3.4 Base Stock | | | | | | |
| GTL 3 Group 11 Base Stock | 12 | 12 | 12 | 12 | 12 | 8 |
| Other Additives | 8.65 | 8.65 | 8.65 | 8.65 | 8.65 | 6.5 |
| Viscosity Modifier concentrate | 2.5 | 1.0 | 0.5 | 1.5 | 1.0 | 2.5 |
| Borated Dispersant 1 | 3.5 | 3.5 | | 3.5 | | |
| Dispersant 1 | | | 3.5 | | 3.5 | 3.5 |
| Dispersant 2 | 4.33 | 4.33 | 4.33 | | | |
| Dispersant 3 | | | | 3.63 | 3.63 | 3.63 |
| Friction Modifier 1 mixed glyceride ester | | | | | | 0.5 |
| Polymeric EtO Friction Modifier 2 | | 1.0 | 1.0 | 1.0 | 1.0 | |

Samples 1-6 each included a PAO base stock, a GTL base stock, and various additives, including one or more dispersants, and a friction modifier. Samples 1-6 each contained 0.5 to 2.5% of a styrene-isoprene star VM which contained 6% of solid polymer. The PAO base stock used in Samples 1-6 was PAO 3.6 Base Stock with a KV100 of 3.6 cSt. The GTL base stock used in Samples 1-6 was GTL 3 Base Stock with a KV100 of 2.7 cSt. Samples 1-6 contained different dispersant mixtures; however, the nitrogen provided by the dispersant combination remained constant. Dispersant 2 was a succinimide dispersant used in Samples 1-3. In Samples 1 and 2, Borated Dispersant 1 was borated. The succinimide dispersant (Dispersant 2) used in Samples 1-3 had a peak molecular weight of 7900 while the succinimide dispersant (Dispersant 3) used in Samples 4-6 had a peak molecular weight of 5400. The polymeric ethylene oxide friction modifier 2 used in Sample Compositions 2-5 had a weight average molecular weight (Mw) of 9,200. The Friction Modifier 1 used in Sample Composition 6 had a weight average molecular weight (Mw) of 330. The Friction Modifier 2 was a poly-hydroxylcarboxylic acid ester of polyalkylene oxide modified polyols.

Properties of Dispersants 1-3 and Borated Dispersant 1 are provided in Table 4 below. In Table 4, TBN is the Total Base Number expressed in terms of equivalent milligrams of potassium hydroxide per gram of the sample, as measured in accordance with ASTM D2896. The molecular weight was determined using gel permeation chromatography with polystyrene calibration standards.

TABLE 4

| Dispersant Properties | | | | | | | | | |
|---|---|---|---|---|---|---|---|---|---|
| Dispersant Name | N (%) | B (%) | D2896 TBN | D4739 TBN | Basic N (%) | KV100 (cSt) | Mn | PDI | Mp (Peak MW) |
| Borated Dispersant 1 | 1.70 | 0.87 | 32.5 | 15.8 | 0.7 | 550 | 4400 | 1.49 | 5500 |
| Dispersant 1 | 1.80 | 0 | 34.7 | 27.0 | 0.96 | 420 | 3800 | 1.42 | 4700 |
| Dispersant 2 | 1.20 | 0 | 24.4 | 16.9 | 0.62 | 575 | n/a | n/a | 7900 |
| Dispersant 3 | 1.43 | 0 | 29.2 | 22.8 | 0.78 | 575 | 4300 | 1.46 | 5400 |

Properties of the base stocks used in Samples 1-6 are provided in Table 5 below.

TABLE 5

| | Base Stock | |
|---|---|---|
| | GTL 3 | PAO 3.6 |
| KV40, cSt | 9.764 | 15.35 |
| KV100, cSt | 2.675 | 3.6 |
| Viscosity Index | 111 | 118 |
| D5293 CCS, −35 C., mPa · s | 580 | 1070 |
| D5800 Noack, % Loss | 40.6 | 13.9 |

As described above, the engine oil lubricant compositions listed in Table 3 were tested for HTHS viscosity, fuel economy, and Noack volatility. The HTHS viscosity was measured in accordance with ASTM D4683. The fuel economy was measured in accordance with PV1496. The Noack volatility was measured in accordance with ASTM D5800. The results of these tests are provided in Table 6 below.

TABLE 6

| | 1 | 2 | 3 | 4 | 5 | 6 |
|---|---|---|---|---|---|---|
| Dispersant Nitrogen, % | 0.11 | 0.11 | 0.12 | 0.11 | 0.12 | 0.12 |
| KV100, eSt | 5.67 | 5.68 | 5.73 | 5.53 | 5.59 | 5.57 |
| HTHS Viscosity (cP @ 150° C.) | 2.02 | 2.04 | 2.05 | 2.01 | 1.96 | 1.97 |
| Fuel Economy Test (% FE) | 2.18 | 2.30 | 2.38 | 2.47 | 2.69 | 2.73 |
| Noack Volatility (wt %) | 16.1 | 15.7 | 15.1 | 15.1 | 14.8 | 14.8 |

The above test results (1 vs. 2) show that inclusion a polymeric ethylene oxide friction modifier provided improved fuel economy while also providing improved Noack volatility. For example, Sample 2 with 1 wt % of polymeric ethylene oxide friction modifier 1 had a fuel economy of 2.30% and Noack volatility of 15.7 wt % while Sample 1 with Borated Dispersant 1 had a fuel economy of 2.18% and Noack volatility of 16.1 wt %. A comparison of Sample 3 versus Sample 2 and a comparison of Sample 5 versus Sample 4 show that replacing Borated Dispersant 1 with non-Borated 1 provides a fuel economy benefit. For Sample 3 versus 2 the benefit is 2.38% versus 2.30%. For Sample 5 versus 4 the benefit is 2.69% versus 2.47%. Even further, the above test results also show that inclusion of a low molecular weight dispersant can also provide similar benefits. For example, Sample 4 with 3.63 wt % of a Dispersant 3 (low molecular weight) had a fuel economy of 2.47% and Noack volatility of 15.1 wt % while Sample 2 with Dispersant 2 having a higher molecular weight had a fuel economy of 2.3% and Noack volatility of 15.7 wt %. Similar results are shown for Sample 5 with a Dispersant 3 versus Sample 3 with Dispersant 2 having a higher molecular weight. Finally, Sample 6 versus Sample 5 shows the low molecular weight mixed glyceride ester friction modifier provides a fuel economy benefit over the polymeric ethylene oxide friction modifier; 2.73% versus 2.69%.

While the disclosure has been described with respect to a number of embodiments and examples, those skilled in the art, having benefit of this disclosure, will appreciate that other embodiments can be devised which do not depart from the scope and spirit of the invention as disclosed herein. Although individual embodiments are discussed, the invention covers all combinations of all those embodiments.

Where a range of values is provided, it is understood that each intervening value, to the tenth of the unit of the lower limit unless the context clearly dictates otherwise (such as in the case of a group containing a number of carbon atoms in which case each carbon atom number falling within the range is provided), between the upper and lower limit of that range and any other stated or intervening value in that stated range is encompassed within the disclosure. The upper and lower limits of these smaller ranges may independently be included in the smaller ranges is also encompassed within the disclosure, subject to any specifically excluded limit in the stated range. Where the stated range includes one or both of the limits, ranges excluding either both of those included limits are also included in the disclosure.

It should also be understood that, unless clearly indicated to the contrary, in any methods claimed herein that include more than one step or act, the order of the steps or acts of the method is not necessarily limited to the order in which the steps or acts of the method are recited.

The following terms are used to describe the present disclosure. In instances where a term is not specifically defined herein, that term is given an art-recognized meaning by those of ordinary skill applying that term in context to its use in describing the present disclosure.

The articles "a" and "an" as used herein and in the appended claims are used herein to refer to one or to more than one (i.e., to at least one) of the grammatical object of the article unless the context clearly indicates otherwise. By way of example, "an element" means one element or more than one element.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of" will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of" "only one of" or "exactly one of."

The term "about" or "approximately" means an acceptable experimental error for a particular value as determined by one of ordinary skill in the art, which depends in part on how the value is measured or determined. All numerical values within the specification and the claims herein are modified by "about" or "approximately" the indicated value, and take into account experimental error and variations that would be expected by a person having ordinary skill in the art.

The phrase "major amount" or "major component" as it relates to components included within the liquid coolants of the specification and the claims means greater than or equal to 50 wt %, or greater than or equal to 60 wt %, or greater than or equal to 70 wt %, or greater than or equal to 80 wt %, or greater than or equal to 90 wt % based on the total weight of the liquid coolant. The phrase "minor amount" or "minor component" as it relates to components included within the liquid coolants of the specification and the claims means less than 50 wt %, or less than or equal to 40 wt %, or less than or equal to 30 wt %, or greater than or equal to 20 wt %, or less than or equal to 10 wt %, or less than or equal to 5 wt %, or less than or equal to 2 wt %, or less than or equal to 1 wt %, based on the total weight of the liquid coolant. The phrase "substantially free" or "essentially free" as it relates to components included within the liquid coolants of the specification and the claims means that the particular component is at 0 weight % within the lubricating oil, or alternatively is at impurity type levels within the lubricating oil (less than 100 ppm, or less than 20 ppm, or less than 10 ppm, or less than 1 ppm).

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

As used herein in the specification and in the claims, the phrase "at least one," in reference to a list of one or more elements, should be understood to mean at least one element selected from anyone or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

What is claimed is:

1. An engine oil lubricant composition comprising a polyalpha olefin base oil component in an amount of about 50 wt % to about 90 wt % based on a total weight of the engine oil lubricant composition, wherein the polyalpha olefin base oil component is a Group IV base oil and has a Noack volatility of about 12.5% to about 15%;

further comprising a Group II base oil component in an amount of about 0.1 wt % to about 50 wt % based on the total weight of the engine oil lubricant composition, wherein the Group II base oil component comprises a gas to liquids base stock;

further comprising a mixed glyceride ester comprising C14, C16, and C18 molecules, wherein a majority of the C14 molecules are linear, a majority of the C16 molecules are linear, and a majority of the C18 molecules are linear;

further comprising a first succinimide dispersant that is non-borated and is present in an amount of about 4.3 wt % based on the total weight of the engine oil lubricant composition, and wherein the first succinimide dispersant has a peak molecular weight of about 4,000 to about 5,000, as determined using gel permeation chromatography with polystyrene calibration standard;

further comprising a second borated succinimide dispersant in an amount of about 3.5 wt %, based on the total weight of the engine oil lubricant composition, wherein the second succinimide dispersant has a peak molecular weight of about 5,000 to about 5,500, as determined using gel permeation chromatography with polystyrene calibration standard, wherein the second borated succinimide dispersant comprises from about 0.1 moles to about 0.87 moles of boron per mole of dispersant reaction product;

further comprising a polymeric ethylene oxide friction modifier in an amount of about 0.1 wt % to about 5.0 wt % based on the total weight of the engine oil lubricant composition;

further comprising a corrosion inhibitor comprising alkylated (C8-C20) phenoxyacetic acid;

wherein the engine oil lubricant composition has a kinematic viscosity at 100° C. of about 10 cSt or less, a high temperature high shear viscosity at 150° C. of about 2.2 cP or less, and a Noack volatility of about 20% or less.

2. The engine oil lubricant composition of claim 1, wherein the polyalpha olefin base oil component has a kinematic viscosity at 100° ° C. of about 5 cSt or less.

3. The engine oil lubricant composition of claim 1, wherein the polyalpha olefin base oil component is present in an amount of about 52 wt % to about 70 wt % based on the total weight of the engine oil lubricant composition.

4. The engine oil lubricant composition of claim 1, wherein the Group II base oil component is present in an amount of about 8 wt % to about 29 wt % based on the total weight of the engine oil lubricant composition.

5. The engine oil lubricant composition of claim 1, wherein the Group II base oil component has a kinematic viscosity at 100° C. of from about 2 cSt to about 6 cSt.

6. The engine oil lubricant composition of claim 1, wherein the polyalpha olefin base stock is present in an amount of about 52 wt % to about 70 wt %, and wherein the Group II base oil component is present in an amount of about 8 wt % to about 29 wt % and comprises a gas to liquids base stock.

7. The engine oil lubricant composition of claim 1, further comprising about 1 wt % to about 3 wt % of a Group V base oil component based on the total weight of the engine oil lubricant composition.

8. The engine oil lubricant composition of claim 1, further comprising a Group V base oil component, wherein the Group V base oil component has a kinematic viscosity at 100° C. of from about 2 cSt to about 6 cSt.

9. The engine oil lubricant composition of claim 1, further comprising at least one additive selected from the group consisting of an anti-wear additive, a viscosity modifier, an antioxidant, a detergent, a pour point depressant, a corrosion inhibitor, a metal deactivator, a seal compatibility additive, an anti-foam agent, an inhibitor, an anti-rust additive, and any combination thereof.

10. An engine oil lubricant composition comprising a polyalpha olefin base oil component in an amount of about 52 wt % to about 70 wt % based on a total weight of the engine oil lubricant composition, wherein the polyalpha olefin base oil component is a Group IV base oil and has a Noack volatility of about 12.5% to about 15%;

further comprising a gas to liquids base oil component in an amount of about 8 wt % to about 29 wt % based on the total weight of the engine oil lubricant composition, wherein the gas to liquids base oil component is a Group II base oil component;

further comprising a first succinimide dispersant that is non-borated and is present in an amount of about 4.3 wt % based on the total weight of the engine oil lubricant composition, and wherein the first succinimide dispersant has a peak molecular weight of about 4,000 to about 5,000, as determined using gel permeation chromatography with polystyrene calibration standard;

further comprising a second borated succinimide dispersant in an amount of about 3.5 wt %, based on the total weight of the engine oil lubricant composition, wherein the second succinimide dispersant has a peak molecular weight of about 5,000 to about 5,500, as determined using gel permeation chromatography with polystyrene calibration standard, wherein the second borated succinimide dispersant comprises from about 0.1 moles to about 0.87 moles of boron per mole of dispersant reaction product;

further comprising a polymeric ethylene oxide friction modifier in an amount of about 0.1 wt % to about 5.0 wt % based on the total weight of the engine oil lubricant composition;

further comprising a corrosion inhibitor comprising benzotriazole;

wherein the engine oil lubricant composition further has a kinematic viscosity at 100° C. of about 4 cSt or less; further has a high temperature high shear viscosity at 150° C. of about 2.2 cP or less; and further has a Noack volatility of about 10% to about 18%.

11. The engine oil lubricant composition of claim 10, wherein the polyalpha olefin base oil component has a kinematic viscosity at 100° C. of about 5 cSt or less.

12. The engine oil lubricant composition of claim 10, wherein the polyalpha olefin base stock is present in an amount of about 60 wt % to about 70 wt %, and wherein the gas to liquids base oil component is present in an amount of about 10 wt % to about 15 wt %.

13. The engine oil lubricant composition of claim 10, wherein the polyalpha olefin base oil component is present in an amount of about 69 wt % to about 76 wt % based on the total weight of the engine oil lubricant composition, and wherein the gas to liquids base oil component is present in an amount of about 9 wt % to about 12 wt % based on the total weight of the engine oil lubricant composition.

14. The engine oil lubricant composition of claim 10, wherein the gas to liquids base oil component has a kinematic viscosity at 100° C. of from about 2 cSt to about 6 cSt.

15. The engine oil lubricant composition of claim 10, further comprising about 1 wt % to about 3 wt % of a Group V base oil component, based on the total weight of the engine oil lubricant composition, wherein the Group V base oil component has a kinematic viscosity at 100° ° C. of from about 2 cSt to about 6 cSt.

16. The engine oil lubricant composition of claim 1, wherein the mixed glyceride ester has a weight average molecular weight of about 330.

17. The engine oil lubricant composition of claim 10, further comprising a mixed glyceride ester comprising C14, C16, and C18 molecules, wherein a majority of the C14 molecules are linear, a majority of the C16 molecules are linear, and a majority of the C18 molecules are linear;

wherein the mixed glyceride ester has a weight average molecular weight of about 330.

* * * * *